US007223039B1

(12) United States Patent
Velickovic

(10) Patent No.: US 7,223,039 B1
(45) Date of Patent: May 29, 2007

(54) POCKET AUTOMATIC ASSEMBLY FOR WASHING AND MAINTAINING DENTAL HYGIENE

(76) Inventor: Pjer-Mise Velickovic, Zagreb (HR)

( * ) Notice: Subject to any disclaimer, the term of this patent is extended or adjusted under 35 U.S.C. 154(b) by 0 days.

(21) Appl. No.: 11/610,710

(22) Filed: Dec. 14, 2006

Related U.S. Application Data

(63) Continuation of application No. PCT/HR2005/000030, filed on Apr. 29, 2005.

(30) Foreign Application Priority Data

Jun. 14, 2004 (HR) ..... P 20040540 A

(51) Int. Cl.
*A46B 11/04* (2006.01)

(52) U.S. Cl. ..... 401/279; 401/140; 401/175; 401/176; 401/179

(58) Field of Classification Search ..... 401/270, 401/278, 279, 140, 175, 176, 179, 180, 268, 401/292, 123, 124, 125; 222/192, 386, 391, 222/392

See application file for complete search history.

(56) References Cited

U.S. PATENT DOCUMENTS

| | | | | | |
|---|---|---|---|---|---|
| 965,309 | A | * | 7/1910 | MacDonald | 401/175 |
| 2,000,910 | A | * | 5/1935 | Appel et al. | 401/191 |
| 2,025,591 | A | | 12/1935 | Folsom-Jones | 132/84 |
| 2,793,792 | A | * | 5/1957 | Pilkington | 222/191 |
| 2,986,766 | A | * | 6/1961 | Landis | 401/175 |
| 3,613,698 | A | * | 10/1971 | Fox | 401/191 |
| 3,816,007 | A | * | 6/1974 | Fox | 401/191 |
| 4,068,974 | A | * | 1/1978 | Meyer et al. | 401/180 |
| 4,467,822 | A | * | 8/1984 | Blackwell | 401/175 |
| 4,693,622 | A | * | 9/1987 | Booth | 401/191 |

(Continued)

FOREIGN PATENT DOCUMENTS

DE 20 2004 006 435 8/2004

(Continued)

OTHER PUBLICATIONS

International Search Report, Feb. 13, 2006. (2 pages).

*Primary Examiner*—Khoa D. Huynh
(74) *Attorney, Agent, or Firm*—St. Onge Steward Johnston & Reens LLC

(57) ABSTRACT

An automatic toothbrushing assembly has a handle casing and a reservoir casing connected to each other by mating grooves and ribs. The reservoir casing has a reservoir space containing toothpaste, and which has an inner stepped series of lateral feet and an opening at an upper end thereof, and a cover. The handle casing has an outer stepped series of feet and contains a brush having a handle and a brush head, with a spring extending between the handle casing and the brush handle. A latching assembly permits latching of the cover to the handle casing. A piston is located in the reservoir space and has elastic lateral wings which incrementally advance upwardly along the stepped series of feet of the reservoir casing, and an elastic piston tail which incrementally advances upwardly along the stepped series of feet of the handle casing upon application of downward sliding force ion the reservoir casing relative to the handle casing, thereby extruding toothpaste to a position where the brush head is located. Opening of the cover releases the brush handle and brush head, and they are propelled upwardly from the handle casing by the spring so that a tooth brush loaded with toothpaste is presented to the user.

13 Claims, 5 Drawing Sheets

U.S. PATENT DOCUMENTS

| | | | | | |
|---|---|---|---|---|---|
| 4,695,177 | A | * | 9/1987 | Kuo | 401/191 |
| 4,787,765 | A | * | 11/1988 | Kuo | 401/191 |
| 4,886,389 | A | * | 12/1989 | Vidovic | 401/191 |
| 2002/0090250 | A1 | | 7/2002 | Blecher | 401/175 |

FOREIGN PATENT DOCUMENTS

| | | | | | |
|---|---|---|---|---|---|
| EP | 0 308 549 | | 3/1989 | | |
| FR | 2623062 | A1 | * | 5/1989 | 401/140 |

* cited by examiner

POCKET AUTOMATIC ASSEMBLY FOR WASHING AND MAINTAINING DENTAL HYGIENE

CROSS-REFERENCE TO RELATED APPLICATIONS

The present application is a continuation of pending International Patent Application PCT/HR2005/000030 filed on Apr. 29, 2005 which designates the United States and claims priority from Croatian patent application P20040540A filed on Jun. 14, 2004, the disclosures of which are hereby incorporated by reference.

FIELD OF THE INVENTION

This invention is related to the maintenance of the dental and mouth space hygiene by means of a pocket automatic assembly that is activated by one thumb press on the assembly cover. So, as the brush comes out of the assembly, simultaneously on it there is also the tooth paste. It has also the possibility of filling the assembly with paste and of replacing the wasted brush. According to the international patent classification (IPC), it is classified as A 61 C-maintenance of the dental and mouth hygiene.

BACKGROUND OF THE INVENTION

Throughout the years one of the problems is, how to make the pocket assembly for washing and maintaining the dental and mouth hygiene that would not be bigger than of the first size. An assembly that could easily be carried in the pocket or handbag. An assembly that would last longer than the other ones on the market. This problem had to be solved in a way that the assembly contains both the tooth paste and the brush, and that it could be activated by one move of the first thumb. The problem was particularly difficult to be solved due to the small size of the assembly, the small number of its composing parts, the drying and stopping up of the channels for the tooth paste passage, then due to the adjustment of the entire cycle in the assembly in order that all actions would terminate simultaneously. So, that, when the brush comes out, simultaneously on it also the tooth paste would be in the position that conditions its correct using at the teeth cleaning. An assembly that would enable the filling with a new tooth paste after the paste doses are spent, and an assembly in which only the brush head would be replaced in case of being worn out. Also, an assembly had to be invented, which could be used by both the left- and right-handed person. It was necessary to satisfy the daily needs for washing and maintaining the teeth hygiene outside the home, at work, during the voyage and at school. Naturally, to make an assembly that would be simple and safe for being used both by the children and the adults.

Up to now, many solutions of this problem have been proposed and made, with more or less success on the market. All proposed assembly devices required a certain time to be used for the teeth cleaning. Some tried to pack a small brush in two parts and a small dose of the tooth paste for two washings into a small box, and after being used it was thrown away into the garbage. Such types of products required a complicated use and didn't achieve the desired results on the wider market. Some others tried to make a channel for the passage of the tooth paste onto the brush through the brush itself. The paste reservoir would be placed into the brush handle, and the tooth paste has been pressed through the channel on the brush, by turning the axle and by lifting the piston. But, they encountered the problem of the paste drying and of the stopping-up of the small channel diameters in the brush due to its dimensions. It is very difficult to clean the channels in this assembly, because it is impossible to reach them. This assembly type is of a normal tooth brush size (180 cm), and there were no pocket measures. Also, it required a certain number of moves in order to activate and use them. All mentioned assemblies are complicated for the production and putting together, and they raise the price of the product on the market.

SUMMARY OF THE INVENTION

The primary scope of the invention is to activate the pocket automatic assembly with one move of the first thumb in a way that, at the brush coming out, on it there would be also the tooth paste for washing and maintaining the teeth and mouth. That the position of the brush, when coming out of the assembly, would condition the correct use and the teeth washing from above downwards. That the pocket automatic assembly would be made according to the anatomy and the size of the first. That it is universal both for the left- and right-handed person and that it is safe for using and light at transport. Also, that it is possible to refill the assembly after the 9 tooth paste doses are empty as well as to replace the brush head when it is worn-out. Also, that all parts can be easily disassembled and assembled for a regular cleaning and maintenance of the assembly.

The secondary scope of the invention is to secure, improve and connect in one whole the assembly with as few parts as possible, in order to obtain such a functional assembly that is more durable than the other ones offered on the market. Also, that its parts are safe for use and that they can perform all the necessary activities in the cycle at the activating. That the process at composing the assembly parts can be made by the machine, in order to get the least possible production price that will be competitive to the other products of a similar assignment on the market.

The further scope of the invention is to enable, that the outer casing of the entire assembly can be used for the marketing purpose as an advertising panel. The pocket automatic assembly, as a personal thing, becomes a suitable present to any person, and sending in the same time the mentioned advertising message on the very assembly.

The additional scopes and advantages of the invention will partly be presented in the following description and partly will be learned through the invention application.

The pocket automatic assembly for cleaning and maintaining the dental and mouth hygiene according to this invention comprises the outer casing of the assembly that consists of two parts: the casing of the handle (static) and the casing of the reservoir (dynamical); by pressing the reservoir casing downwards, certain activities in the assembly itself are activated, firstly, the opening of the assembly cover, then, simultaneously the lifting of the handle with the brush head by means of a spring and the filling of the brush with the tooth paste; the handle with the brush and paste rotates after the filling for 90° in the desired sense depending on the either left-handed or right-handed user; after stopping the handle with the brush head on a normal height of 18 cm, the further downward motion of the handle is blocked by pressing on the automatically adjusted cover of the assembly casing in the direction towards the handle, in the reservoir casing there is a piston with wings and a tail that help to press out the tooth paste on the brush; the wings on the piston move on the lateral sides of the reservoir interior and the tail of the piston moves on the outer side of the cylinder casing; after the pocket assembly is used and the brush is washed, the reservoir casing is returned into the initial position and the handle is returned into the handle casing, then, the cover of the pocket assembly is closed. After emptying the 9 doses of the tooth paste in the assembly, the filling of the assembly with a new tooth paste is enabled in a way that the casing of the assembly reservoir is drawn downwards to the end of the container top, the little piston is returned on the reservoir bottom and the filling of the tooth paste along the entire reservoir is performed, after filling the reservoir, the casing of the assembly is returned into the initial position and the cover of the assembly is closed.

The advantage is also given at the replacement of the brush when it is worn out, in a way that it can be easily taken off the pin on the brush handle, and a new brush head can be inserted and fixed, it is sufficient to push the brush head on the wedge and it fastens itself alone by means of it's pincers at the pin on the handle.

Primarily, the device for pressing the handle and the brush head upwards includes the spring that is placed, when folded, in the opening on the bottom and on the handle itself, i.e. on the spring guide in the inner part of the bottom of the handle casing and of the upper part of the inner opening in the brush handle. The spring can also be of conical shape, with a mild inclination of its slopes, in order to avoid its lateral curving during the folding.

BRIEF DESCRIPTION OF THE DRAWINGS

The Figures are presented as spatial views (isometric drawings) onto the entire assembly and onto the assembly parts denoted from 1 to 8.

The first two

Also, the top-views on the assembly and the assembly parts are presented, and they are denoted by the sign (') above the Figure number. Also, they contain the denoted position on them.

All positions on the Figures of the assembly and the assembly parts are denoted with two-digit numbers from 10 to 41. Each position on the assembly part has its unique number that represents it on all Figures, where it can be seen.

Figure 1:
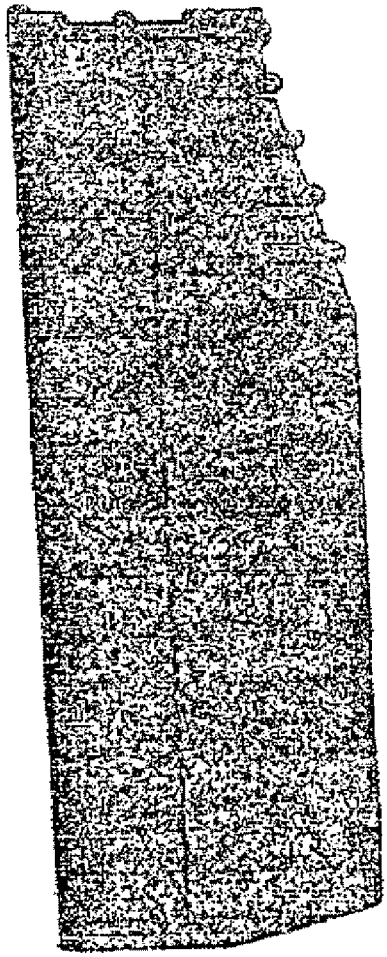
FIGS. 1 and 2 represent the assembly in the closed position and in the activated open position. The other Figures represent the assembly parts with the denoted position on them.
Figure 1:
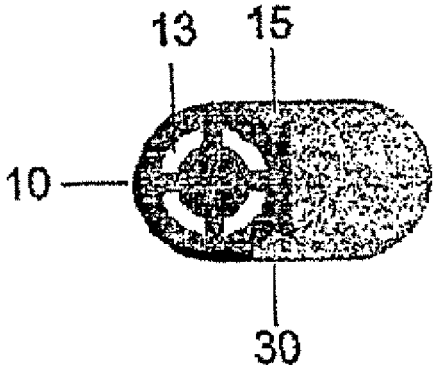
Figure 2:
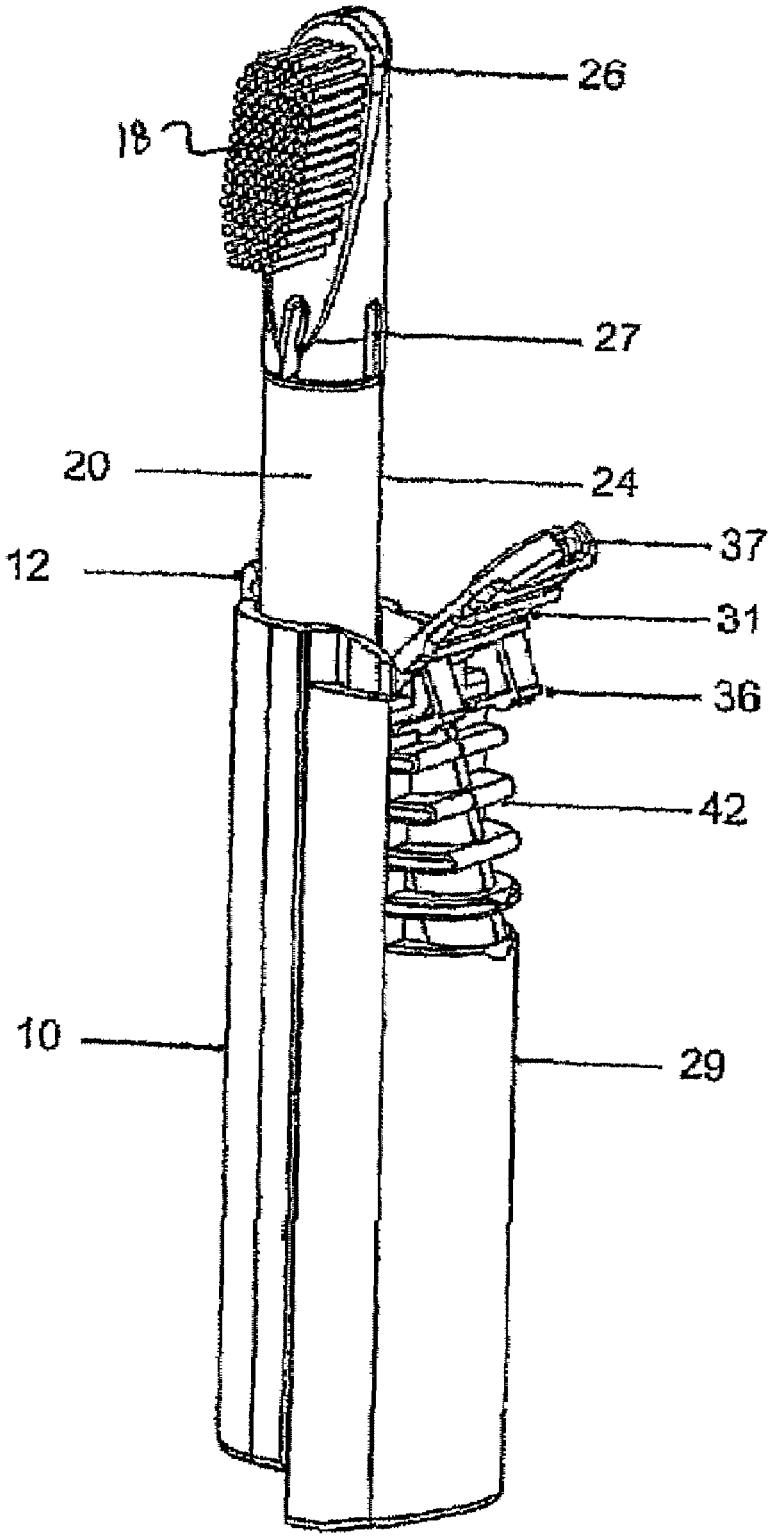
Figure 3:
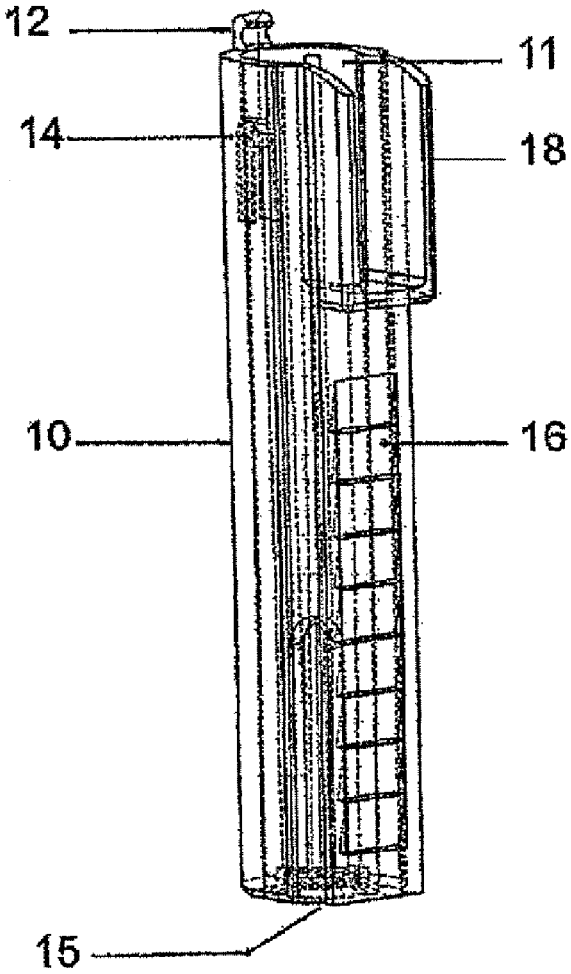
Figure 4:
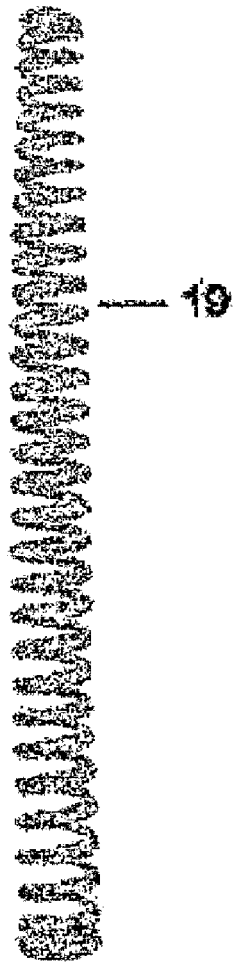
Figure 3:
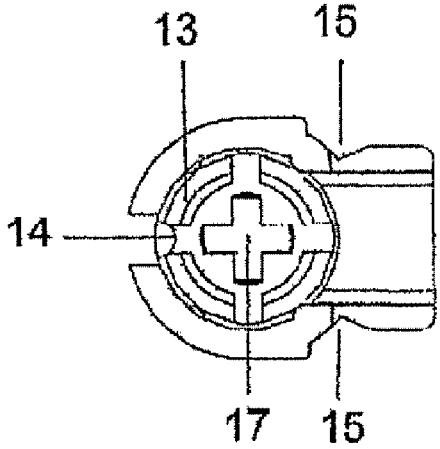
Figure 6:
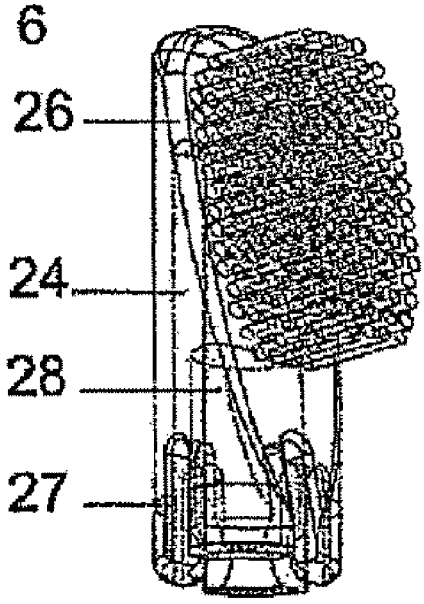
Figure 6:
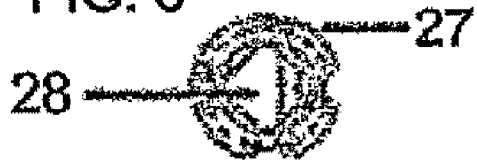
Figure 5:
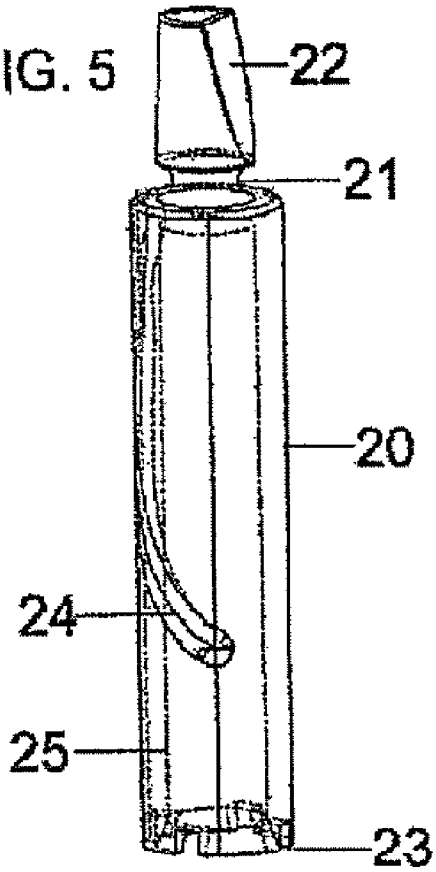
Figure 5:
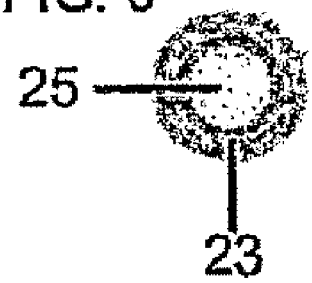
Figure 7:
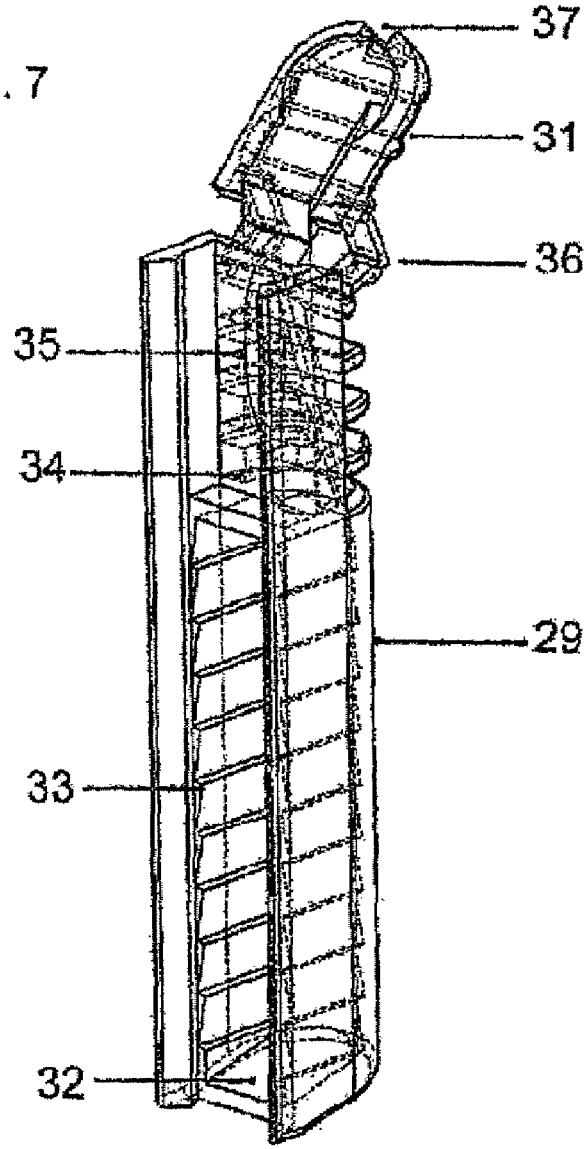
Figure 8:
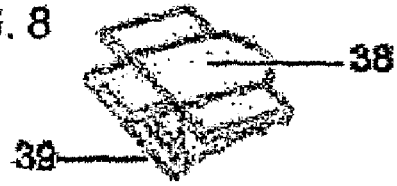
Figure 8:
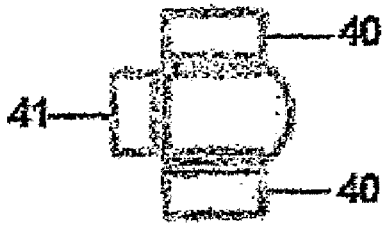
Figure 8:
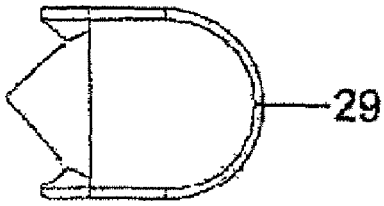

FIG. 1 presents the spatial view on the closed automatic assembly, constructed in accordance with the described invention FIG. 1' presents the top view of the bottom of the pocket automatic assembly FIG. 2 presents the spatial view of the open pocket automatic assembly that is constructed in accordance with the described invention FIG. 3 presents the spatial view of the casing of the brush head handle FIG. 3' presents the top view of the bottom of the brush head handle FIG. 4 presents the spatial view of the spring, which has a greater diameter on the bottom and a smaller one on the top FIG. 5 presents the spatial view of the handle with the pin for the brush head FIG. 5' presents the top view drawing of the bottom of the brush head handle FIG. 6 presents the spatial view to the brush head FIG. 6' presents the top view drawing of the bottom of the brush head FIG. 7 presents the spatial view on the reservoir casing Figure T presents the top view drawing of the bottom of the reservoir casing FIG. 7' presents the top view drawing of the bottom of the reservoir casing FIG. 8 presents the spatial view of the piston in the reservoir for pressing the tooth paste FIG. 8' presents the top view drawing of the reservoir piston

DETAILED DESCRIPTION OF THE INVENTION

The elements on the Figures are described by the two-digit numbers.

Element 10 identifies a casing of the brush handle.

Element 11 identifies a space where the brush handle is placed.

Element 12 identifies a closer of the assembly cover.

Element 13 identifies an opening on the bottom of the handle casing for the air under-pressure and the water discharge from the casing at the cleaning.

Element 14 identifies an elastic groove about which rotates the brush handle for 90° to the left or to the right.

Element 15 identifies side grooves-sliders, which serve for connecting the assembly and for the sliding at the reservoir casing.

Element 16 identifies impressed feet for blocking the reservoir piston on them, when the tooth paste leaves the reservoir.

Element 17 identifies a space of the spring guide in the inner bottom of the handle casing.

Element 18 identifies lateral sides of the bristles corrector in the assembly.

Element 19 identifies a spring made of the Stenly-stile material, of the mild conical shape.

Element 21 identifies a circular groove for fixing the brush head to the handle.

Element 22 identifies a wedge for preventing the rotation of the brush head on it.

Element 23 identifies cross grooves for closing the bottom of the brush casing.

Element 24 identifies a spiral groove for the handle rotation for 90°.

Element 25 identifies an opening in the handle for placing the spring.

Element 26 identifies a brush head with the bristles.

Element 27 identifies an elastic pincers on the bottom of the brush head.

Element 28 identifies a groove for connecting the brush head with the pin on the handle.

Element 29 identifies a reservoir casing.

Element 30 identifies lateral furrows for connecting the sliders with the handle casing.

Element 31 identifies an assembly cover on the reservoir casing.

Element 32 identifies a space in the reservoir for the tooth paste.

Element 33 identifies laterally pressed feet for lifting the reservoir piston as the tooth paste doses are consumed.

Element 35 identifies an opening for delivering the tooth paste on the brush bristles.

Element 36 identifies elastic springs for opening the assembly cover.

Element 37 identifies a furrow for closing the assembly cover with the handle casing.

Element 38 identifies a reservoir piston.

Element 39 identifies a piston holders that prevent for curving in the reservoir.

Element 40 identifies lateral elastic wings that serve for lifting the piston upwards, as the reservoir gets empty.

Element 41 identifies an elastic piston tail that serves for blocking the piston motion at the getting-out of the tooth paste.

Element 42 identifies a toothed inclined part of the reservoir casing, made according to the hand first anatomy.

Referring to FIGS. 1 and 1' it can be seen, that the assembly from the outer side comprises the casing of the brush handle 10, and the reservoir casing 29, with the elastic cover of the entire assembly 31. On the top view drawing, FIG. 1', it can be seen that the entire assembly is rounded, without sharp angles. That gives to it the possibility of being used for the marketing purpose, as an advertising panel. The assembly part 42 where the thumb of the hand comes is slightly toothed, so that it might not slide under the thumb of the hand.

In FIG. 2 it can be seen, how the assembly looks like when it is open, handle 20 with brush head 26 is rotated for 90°. The rotation sense depends on, whether a left-handed or right-handed person uses it. Assembly cover 31 is entirely open to enable a smooth extension of handle 20 with brush head 26 and the tooth paste. Handle 20 with brush head 26 stops at the end of spiral groove 24 on it. At that, elastic small springs 36 help cover 31 by tensioning it into that position. For using the assembly it is necessary to press cover 31 with the thumb towards handle 20 of the brush head, in order to block its downward motion. FIG. 3 presents the important parts on the casing of handle 10 of the brush head, such as closer 12 of the assembly cover. Elastic furrow 14 provides the rotation of the handle with brush head in handle casing 10. Correctors 18 retain the brush bristles when the brush head is retracted into the closed position. Feet 16 block the piston at the tooth paste pressing-out on the brush head are placed. Openings 13 on the bottom of the brush handle casing for the water discharge during the assembly cleaning can be seen. Openings 13 serve to prevent also the creation of the under-pressure at the handle coming out from the casing. Grooves 15 are left and right grooves for the connecting of the assembly with the reservoir casing. They serve to enable a smooth sliding of the reservoir casing on them and to prevent the tooth paste leaking from the reservoir.

In FIG. 4 spring 19 is presented, which has its narrower part into the opening in the handle 25 of FIG. 5 of the brush head, and leans with its wider part against the bottom of inner part 17 of the handle casing. In such a way it presses the handle upwards and in the same time rotates it via the groove on handle 24 and the elastic furrow 14. Spring 19 has the form of a cone, with a slight inclination to prevent its curving at the folding-up.

FIG. 5 presents handle 20 of the brush head, which consists of handle body 20, and the pin 22. Opening 25 for placing spring 19 is positioned through the handle body from the bottom to the pin. The pin itself consists of two parts. The first upper one fixes the brush head to the handle and prevents its rotation and swaying. The other lower part of the pin has a circular groove that firmly connects the brush head to prevent its failing out of the handle 21. On the handle bottom four grooves 23 lean against the handle casing, and in such a way they close the opening for the air and the water discharge 13. According to this embodiment, the brush head, seen in FIG. 6, can be replaced after it is worn out. It can be easily connected to the handle via the pin 22 in the handle 21 and the groove 28 in the brush head, and the elastic pincers 27 that connect them firmly with handle 20. On the brush back there is vertical groove 26, in which enters elastic furrow 14 that is placed on handle casing 10. In the inner space of the brush head itself there is groove 28 with elastic pincers 27, through which passes wedge 22 with circular groove 21.

In FIG. 7 the appearance of reservoir casing 29 can be seen. It is open by its entire length for an easier filling with the tooth paste 32. FIG. 7 presents the appearance and disposition of the lateral feet 33 for lifting the piston upwards, as the reservoir gets empty. As seen in FIG. 1', furrows 30 enter into grooves 15 on the casing of the brush head casing. In such a way they slide on them.

The last part of the assembly is presented in FIG. 8 and represents the piston 38 of the reservoir that moves in the assembly by means of the wings and tail. Wings 40 enter in lateral feet 33 in the inner part of the reservoir casing, and tail 41 enters into the feet on the handle casing 16. Wings 40 and tail 41 on the little piston are elastic and have the tendency of stretching. In such a way they always lean against the little feet on handle casing 16 and reservoir casing 33. In FIG. 8 piston holder 39 is seen. Piston holder 39 prevents the piston curving in the reservoir.

The assembly functions as follows. The downward sliding of the reservoir casing 29 relative to the handle casing 10 causes the piston 38 to move upwardly incrementally one step of the stepped series of feet in the reservoir casing 29 to extrude toothpaste from the reservoir space 32 through the opening 35 into the corrector 18 where the bristles of the brush head 26 are located. The travel of the piston 38 is stopped by the action of the piston tail 41 hitting the stops of the feet 16 of the handle casing. The bristles are thereby loaded with toothpaste extruded by the piston.

The sliding force will cause the assembly cover 31 to be opened. (Alternatively, the assembly cover 31 can be opened manually by releasing the closer 12 from the cover 31). When the cover is opened, the brush handle 20 with the brush head 26 are released and move upwardly due to the force applied by the spring 19. After the brush head 26 is extended from the handle casing 10, the brush head 26 rotates to a selected position depending on the orientation of the groove 24 in handle 20. Thumb pressure on the cover 31 towards the handle prevents retraction of the brush head 26.

After use, the brush handle 20 with the brush head 26 are pushed back into the handle casing 10, and the assembly cover 31 is latched in place by closer 12. Upward sliding force is applied to the reservoir casing 29 relative to the handle casing 10 to position the reservoir casing 29 in its original position relative to the handle casing 10.

After emptying of the assembly of toothpaste, the tooth paste dose in the reservoir can be refilled. The reservoir casing is moved upwardly relative to the handle casing 10 to retract the reservoir piston 38. This motion is repeated until the reservoir piston 38 is retracted to the downward position and the entire reservoir 32 length can be filled with toothpaste. After the reservoir is refilled, the parts are returned to their initial position and the cover of the assembly is closed.

The brush head 26 can be replaced when it is worn out, extending the useful life of the assembly. Also, the entire assembly can be easily disassembled for cleaning and washing of its inner parts and then reassembled.

The invention of the pocket automatic assembly enables a practical, durable and useful device that can be economically produced and arranged by means of the machine in one whole. In such a way it can achieve a small competitive production cost even to an ordinary tooth brush. Also, this assembly enables the sale of spare brush heads. It is much better than all at present known devices of this purpose. Also, it includes all necessary improvements, as at activating it by one move of the first thumb so also at filling it with the tooth paste after emptying the reservoir and at the possibility of replacing the worn-out brush head with a new one. Its application is at work, in the school as well as in the terrestrial, air and maritime transport.

What is claimed is:

1. A pocket toothbrushing assembly, comprising:

a hollow handle casing and a hollow reservoir casing connected to each other by mating grooves and ribs, the handle casing and reservoir casing forming a rounded exterior sized to be handheld;

the handle casing having a spring receiving guide, and a outer stepped series of feet;

the reservoir casing having reservoir space with an inner stepped series of lateral feet and an opening at an upper end thereof, and a cover;

a latching assembly for latching the cover to the handle casing;

a brush having a handle and a brush head;

a spring extending between the spring retaining guide of the handle casing and the brush handle;

a piston located in the reservoir space having elastic lateral wings which incrementally advance upwardly along the stepped series of feet of the reservoir casing and an elastic piston tail which incrementally advances upwardly along the stepped series of feet of the handle casing.

2. The pocket toothbrushing assembly of claim 1, wherein downward sliding of the reservoir casing relative to the handle casing causes the piston to move upwardly incrementally one step of the stepped series of feet in the reservoir casing.

3. The pocket toothbrushing assembly of claim 2, wherein the reservoir space contains toothpaste, and upward incremental movement of said piston causes toothpaste to be extruded from the reservoir space to a position where the brush head is located.

4. The pocket toothbrushing assembly of claim 3, wherein toothpaste is extruded from the reservoir space through an opening into a portion of the handle casing.

5. The pocket toothbrushing assembly of claim 4, wherein the handle casing has a corrector which is fittable into an upper end of said reservoir casing above said reservoir space, and toothpaste is extruded from the reservoir space through an opening into the corrector.

6. The pocket toothbrushing assembly of claim 4, wherein travel of the piston is stopped by the action of the piston tail hitting stops of the stepped series of feet of the handle casing feet of the handle casing.

7. The pocket toothbrushing assembly of claim 3, wherein downward sliding of the reservoir casing relative to the handle casing causes the cover to be opened.

8. The pocket toothbrushing assembly of claim 1, wherein opening of the cover releases the brush handle and brush head, and the brush handle and brush head move upwardly from the handle casing due to the force applied by the spring.

9. The pocket toothbrushing assembly of claim 8, wherein the handle casing has an inwardly extending elastic furrow, and the brush handle has a spiral groove, such that upward movement of the brush handle and brush head causes 90° rotation of the brush by the engagement of the inwardly extending elastic furrow of the handle casing with the brush handle spiral groove.

10. The pocket toothbrushing assembly of claim 8, wherein the brush handle and brush head are retractable into the handle casing by pressure applied to the brush head.

11. The pocket toothbrushing assembly of claim 1 wherein upward sliding force applied to the reservoir casing relative to the handle casing positions the reservoir casing in an original position relative to the handle casing.

12. The pocket toothbrushing assembly of claim 1 wherein the reservoir space is refillable by moving the reservoir casing upwardly relative to the handle casing to retract the piston.

13. The pocket toothbrushing assembly of claim 1 wherein the brush head snap fits to the brush handle.

* * * * *